United States Patent [19]

Torre

[11] Patent Number: 4,647,910

[45] Date of Patent: Mar. 3, 1987

[54] SELECTOR FOR AC MAGNETIC INDUCTIVE FIELD RECEIVER COILS

[75] Inventor: John J. Torre, Monroe, N.Y.

[73] Assignee: Allied Corporation, Morris Township, Morris County, N.J.

[21] Appl. No.: 777,057

[22] Filed: Sep. 17, 1985

[51] Int. Cl.[4] ..... G08B 13/24

[52] U.S. Cl. ..... 340/551; 340/572

[58] Field of Search ..... 340/572, 551; 343/6.5 LC, 6.5 R, 6.8 LC, 6.8 R

[56] References Cited

U.S. PATENT DOCUMENTS

| | | | |
|---|---|---|---|
| 4,251,808 | 2/1981 | Lichtblau | 340/572 |
| 4,260,990 | 4/1981 | Lichtblau | 340/572 |
| 4,539,558 | 9/1985 | Fearon | 340/551 |

*Primary Examiner*—Glen R. Swann, III

*Attorney, Agent, or Firm*—Ernest D. Buff; Gerhard H. Fuchs

[57] ABSTRACT

An inductive magnetic field article surveillance system includes a generator for a first magnetic field. Articles to be monitored include a structure responsive to the first magnetic field for deriving a second inductive magnetic field having a predetermined frequency. An inductive magnetic field receiver responsive to the second magnetic field includes a receiver coil arrangement for deriving a signal that is a replica of variations of the second magnetic field. Processing circuitry responds to the receiver coil arrangement to derive an indication of the presence of the structure. The receiver coil arrangement includes first and second coils likely to have different responses to the second magnetic field. Only one of the first and second coils is connected to the processing circuitry at a time, as a function of which coil is supplying a signal at the predetermined frequency of the second field to the processing circuitry for at least a predetermined time interval.

18 Claims, 12 Drawing Figures

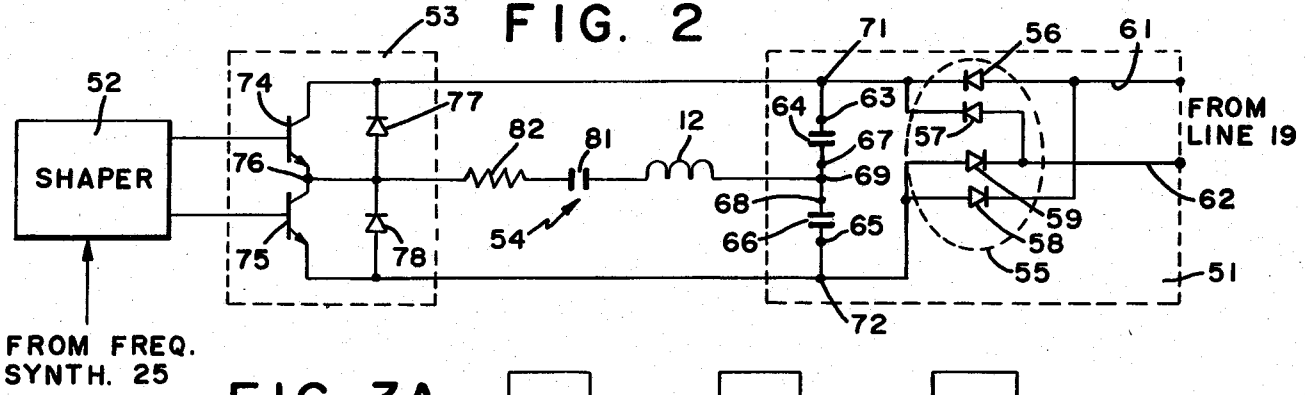
FIG. 2
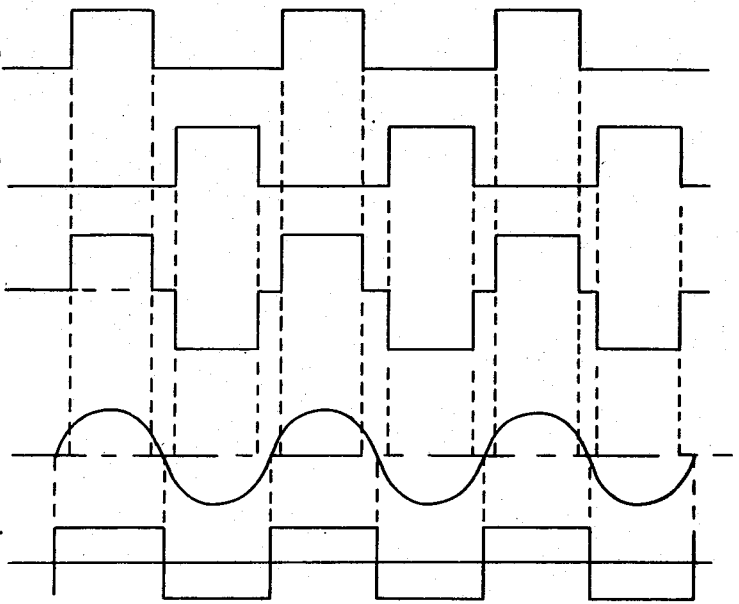
FIG. 3A
FIG. 3B
FIG. 3C
FIG. 3D
FIG. 3E

SELECTOR FOR AC MAGNETIC INDUCTIVE FIELD RECEIVER COILS

TECHNICAL FIELD

The present invention relates generally to inductive magnetic field article surveillance systems and more particularly to an inductive magnetic field article surveillance system including a magnetic field receiver containing two coils, only one of which is connected to a processor at a time as a function of which coil is supplying a signal indicative of the presence of a surveilled article.

BACKGROUND ART

One type of article surveillance system includes an inductive magnetic field generator for deriving a first magnetic field having a predetermined frequency. An article to be monitored includes a structure responsive to the first magnetic field for deriving a second magnetic field having a predetermined frequency. A receiver for the predetermined frequency of the second inductive magnetic field provides an indication of the presence of an article in a monitored region between coils of the generator and receiver by activating an alarm in response to the predetermined frequency of the second magnetic field being received for at least a predetermined interval.

Several different arrangements of the receiver coils have been employed. One of the most common types of receiver coils is a simple, single wire loop having a predetermined number of turns. The size of the loop is such as to cover a specific area or zone. The single wire loop arrangement has several disadvantages, one of which is that the size of the loop must be relatively large to cover a typical region to be monitored, such as a retail establishment exit. A large single wire loop is likely to be subjected to a high level of background magnetic noise. In addition, a large area wire loop has relatively low magnetic field sensitivity and is very orientation dependent. It is intolerable in virtually all article surveillance systems utilizing AC magnetic fields for the loop to be magnetic field orientation sensitive because of the completely random nature of the orientation of the emitting structure on the surveilled article relative to the magnetic field receiver.

To improve the performance of the large single loop coils, many article surveillance systems have employed coils shaped as a figure 8. A figure 8 coil includes two loops, with the wire forming the loops typically wound in opposite directions. An advantage of a figure 8 coil arrangement is that background noise incident on both loops is cancelled by the opposing directions of the windings or conductors forming each loop. In addition, the opposite winding directions of the figure 8 coils and the smaller size of the loops forming the figure 8 enable the figure 8 coil to be less orientation sensitive than a single loop.

It has been found, however, that the figure 8 coil arrangements are relatively insensitive to magnetic fields in the region of an intersection of the loops. Magnetic fields from the surveilled article incident on the coil arrangement in the vicinity of the intersection of the opposing loops have a tendency to be cancelled, to create a dead zone that is unresponsive to the magnetic field derived from the surveilled article.

It is possible to obviate the dead zone of the oppositely wound figure 8 loops by winding both loops in the same direction. However, the background noise level with such an arrangement is increased relative to the background noise which is induced in the oppositely wound figure 8 loops. Typically, signals derived from figure 8 loops wound in the same direction or in opposite directions have been analyzed by connecting the wires forming the two loops in series. Thus, a single signal is coupled from the loops to processing circuitry of the receiver.

It is, accordingly, an object of the present invention to provide a new and improved receiver coil arrangement for an inductive magnetic field surveillance system.

Another object of the invention is to provide an inductive magnetic field surveillance system with an improved receiver coil arrangement having relatively high sensitivity, immunity to background noise and without dead bands or orientation sensitivity.

DISCLOSURE OF INVENTION

In accordance with the present invention an inductive magnetic field article surveillance system includes a generator for a first magnetic field having a predetermined frequency. Articles to be monitored include a structure for receiving the first magnetic field and for deriving a second magnetic field having a predetermined frequency. A receiver includes a coil arrangement responsive to the second magnetic field. The coil arrangement of the receiver responds to the second magnetic field to derive a signal that is a replica of variations of the second magnetic field, as incident on the receiver coil arrangement. Processing means of the receiver responds to the signal derived by the receiver coil arrangement. The receiver coil arrangement includes first and second coils wound as planar loops and likely to have different responses to the second magnetic field. Only one of the first and second coils is connected to the processing means at a time. The selection of which one of the receiver coils is connected to the processing means is determined as a function of which coil is supplying a signal at the predetermined frequency of the second field to the processing means for at least a predetermined time interval.

In the preferred embodiment, only one of the coils is connected at a time to the processing means on a sequential basis. Feedback means responsive to an output signal of the processing means indicating the presence of a surveilled article controls the connections of the first and second coils to the processing means. As long as one of the coils is supplying the predetermined frequency of the second field to the processing circuitry for at least the predetermined time interval, the other coil is decoupled from the processing means. Thus, when the first coil is no longer supplying a signal having the predetermined frequency of the secon magnetic field to the processing means for the required interval, the sequential coupling of output signals of the coils to the processing means is resumed.

Because a single loop is coupled to the processing means at a time, the processing means is responsive to a signal having half of the background noise of a large loop. In addition, increased signal level, hence greater sensitivity, is attained than with a single loop or a figure 8 antenna having loops wound in the same or opposite directions. The larger signal level occurs because of the improved coupling of the second magnetic field to the loops and the decreased orientation dependency that the smaller loops have than is true for a large coil or the figure 8 coils.

It has also been found that selecting one of the coils provides improved performance relative to a similar coil arrangement wherein the responses from the coils are always sequentially coupled to the processing circuitry. If separate small loops are always sequentially coupled to the processing circuitry, only one-half of the information is likely to be available to the processing circuitry that is available by latching onto the loop which is supplying the processing circuitry with a signal meeting the frequency and time requirements of a surveilled article. This is because one of the loops may not be producing a signal with the required frequency, amplitude and time duration constraints for a surveilled article. Hence, always sequentially coupling output signals from the two loops to the processing circuitry produces a weaker overall signal in many instances since both loops are target orientation sensitive. The magnetic field derived from the structure on the article has a tendency to be coupled to the loop closest to the article containing the emmitting structure therefor, whereby the loop farther away from the structure has a tendency to have a lower output signal that is not detectable.

The above and still further objects, features and advantages of the present invention will become apparent upon consideration of the following detailed description of one specific embodiment thereof, especially when taken in conjunction with the accompanying drawings.

BRIEF DESCRIPTION OF THE DRAWINGS

FIG. 2 is a circuit diagram of the generator illustrated in FIG. 1;

FIGS. 3A–3E are waveforms helpful in describing the operation of FIG. 2;

BEST MODE FOR CARRYING OUT THE INVENTION

Figure 1:
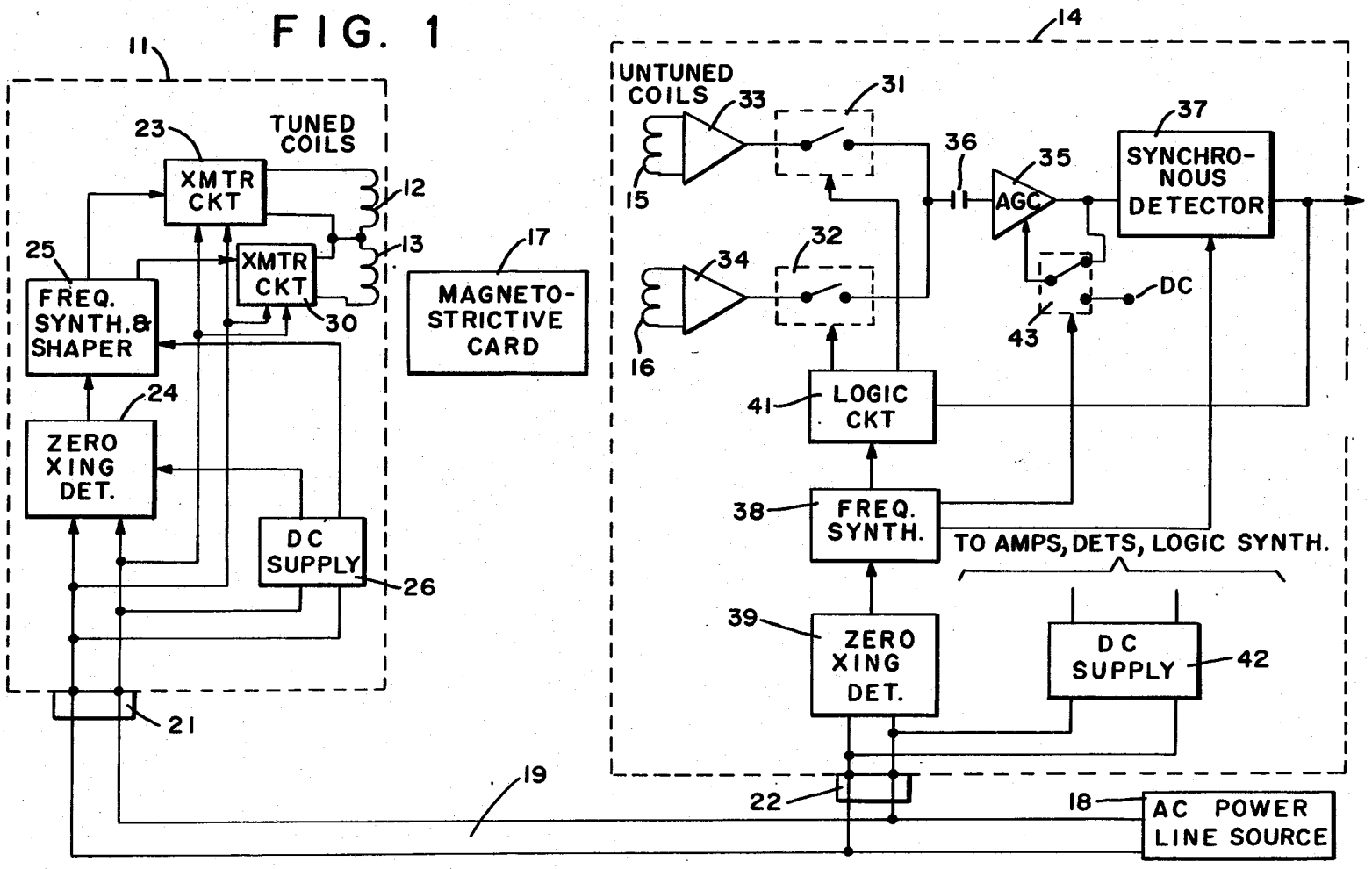
FIG. 1 is a system block diagram of an article surveillance system incorporating the present invention.

Reference is now made to FIG. 1 of the drawing wherein there is illustrated a surveillance system incorporating the present invention. The surveillance system includes a power line activated inductive magnetic field generator or transmitter 11 having an on-off duty cycle considerably less than 50%. While generator 11 is activated into the on duty cycle portion, it derives a first AC magnetic field having a predetermined frequency, typically 60 KHz. In the preferred embodiment, the duty cycle is approximately 6.4%, achieved by having on and off duty cycle portions with durations of 1.6 and 23.4 milliseconds, respectively. The magnetic field derived by generator 11 is inductively coupled from tuned coils 12 and 13, located on one wall of a region to be monitored.

Inductive AC magnetic field power line activated receiver 14 is selectively responsive to the magnetic field derived by generator 11. Receiver 14 includes untuned magnetic field responsive coils 15 and 16, mounted on a wall opposite from the wall containing coils 12 and 13. AC magnetic field inductive coupling subsists between coils 12 and 13 and at least one of coils 15 and 16 while coils 12 and 13 derive the magnetic field generated by transmitter 11. However, receiver 14 is effectively decoupled from coils 15 and 16 while coils 12 and 13 are energized. A second inductive magnetic field having a fixed predetermined carrier frequency but variable duration and amplitude is coupled to coils 15 and 16 and receiver 14 immediately after expiration of the on duty cycle portion of transmitter 11 when an article containing magneto-strictive card 17 passes in the region between the walls containing coils 12, 13 and 15–16. The second field is detected and recognized by receiver 14 as being associated with the article passing between coils 12, 13 and 15, 16.

Card 17 is preferably manufactured in accordance with the teachings of commonly assigned U.S. Pat. No. 4,510,489, to Anderson III, et al. Typically, card 17 is carried on an article to be detected by an interaction of components in the card and the magnetic field derived from generator 11 and transduced by receiver 14. Card 17 is normally in an activated state, where it effectively functions as a resistance-inductance-capacitance (RLC) circuit that responds to the AC inductive magnetic field derived by generator 11. Card 17 stores the magnetic field derived from generator 11. When a pulse of the first magnetic field has terminated, the elements in magneto-strictive card 17 re-radiate the second magnetic field that is detected by receiver 14. Magneto-strictive card 17 is selectively deactivated by an appropriate operator, such as a checkout cashier, causing the AC inductive magnetic field re-radiated by the card to be undetectable by receiver 14.

Transmitter 11 and receiver 14 are synchronously activated in response to zero crossings of AC power line source 18, to enable the receiver to respond to the inductive magnetic field re-radiated from card 17 upon completion of an on duty cycle portion of transmitter 11. By synchronizing the operation of generator 11 and receiver 14 in response to zero crossings of AC power line source 18, electronic circuits included in the generator and receiver need not be electrically connected together, except by power line 19 that is connected to conventional male plugs 21 and 22 of the generator and receiver, respectively.

Generator 11 includes transmitter circuits 23 and 30 for seaparately and simultaneously driving tuned coils 12 and 13 with a 60 KHz carrier having a 6.4% duty cycle, such that coils 12 and 13 are supplied with sinusoidal currents at a predetermined constant frequency of 60 KHz for 1.6 milliseconds. For the next 23.4 milliseconds, coils 12 and 13 are not driven by transmitter circuits 23 and 30.

Transmitter circuits 23 and 30 are identical, with each including a transformerless AC power line to DC converter and switch means that supplies currents from opposite terminals of the AC to DC converter to coils 12 and 13 at the 60 KHz frequency, during the on duty cycle portions. To these ends, transmitter circuits 23 and 30 are directly responsive to the AC power line voltages on line 19, as coupled to generator 11 by way of male plug 21. Transmitter circuits 23 and 30 are activated into the on duty cycle portions thereof in synchronism with zero crossings of the AC voltage of power line 19, as coupled to generator 11 by way of plug 21, a result achieved by connecting zero crossing detector 24 to plug 21 so the detector derives a pulse each time the voltage on power line 19 goes through a zero value. The zero crossing indicating pulses derived by detector 24 are coupled to frequency synthesizer and shaper 25, having outputs fed to transmitter circuits 23 and 30, to cause the transmitter circuits to be activated to produce the 60 KHz bursts having the 6.4% duty cycle.

DC power is supplied to components in zero crossing detector 24 and frequency synthesizer and shaper 25 by DC supply 26, connected to line 19 by male plug 21. Supply 26 does not have the capability of providing sufficient power to derive the necessary AC inductive magnetic fields from coils 12 and 13 to be a power supply for transmitter circuits 23 and 30.

Transmitter circuits 23 and 30 are responsive to frequency synthesizer and shaper 25 so that both the transmitter circuits are simultaneously activated to simultaneously derive the same frequency during the on duty cycle portion of each activation cycle of the transmitter circuits. During alternate on duty cycle portions, transmitter circuits 23 and 30 supply in phase and out of phase currents to coils 12 and 13. Thus, during a first on duty cycle pcrtion, the currents supplied by transmitter circuits 23 and 30 to coils 12 and 13 cause current to flow in the same direction through the coils, relative to a common terminal for the coils. During the next, i.e ., second, on duty cycle portion, the currents supplied by transmitter circuits 23 and 30 to coils 12 and 13 flow in opposite directions in the coils relative to the common coil terminal.

Such a result is achieved by synthesizer 25 activating switches in transmitter circuits 23 and 30 so that the switches are activated in the same sequence, at the 60 KHz frequency, during the first duty cycle portion. During the second duty cycle portion, the switches in transmitter circuits 23 and 30 are operated in opposite, manners in response to switching signals from frequency synthesizer and shaper 25 to cause the AC currents in coils 12 and 13 to have opposite relative polarities. Thus, for example, the switches of transmitter circuit 23 are always driven in the same sequence. In contrast, the switches of transmitter circuit 30 are driven during a first duty cycle portion in the same sequence as the switches of transmitter circuit 23, but during the next duty cycle portion, the activation times of the switches in transmitter circuit 30 are reversed relative to the activation times of the transmitter circuit 30 during the preceding burst.

By driving coils 12 and 13 with in phase and out of phase currents during different duty cycle portions, mutually orthogonal magnetic fields are derived from generator 11. This enables untuned coils 15 and 16 of receiver 14 to transduce the second magnetic fields of card 17, regardless cf the orientation of the card relative to coils 12 and 13. The result is achieved even though coils 12, 13, 15 and 16 are all vertically disposed planar loops of wire. The loops forming coils 12 and 13 are preferably non-overlapping rectangular loops having vertically and horizontally disposed sides.

In response to coils 12 and 13 being driven by in phase currents by circuits 23 and 30 to produce in phase magnetic field flux lines, i.e., flux lines that are directed in the same direction in the centers of the loops, a horizontally directed field at right angles to the plane of the loops is produced in the vicinity of adjacent wires of the loops forming coils 12 and 13. The magnetic flux lines between the centers of the loops forming coils 12 and 13, on one side of the plane of the loops, are oppositely directed in the vertical direction on opposite sides of adjacent wires of the loops forming coils 12 and 13.

Hence, in response to the stated in phase magnetic fluxes in the loops forming coils 12 and 13, there is a relatively intense magnetic flux field to provide X axis coverage for the magnetic field responsive elements in card 17 but there is a weak vertical magnetic field due to the cancellation effect of the oppositely directed vertical fields.

A vertically directed magnetic flux field in the region between tuned transmitter coils 12 and 13 and untuned coils 15 and 16 is provided by driving the loops forming coils 12 and 13 so the magnetic fluxes generated in the centers of the loop flow in opposite directions, i.e., have an out of phase relationship. The out of phase relationship for the fluxes of loops 12 and 13 causes the lines of flux to flow in opposite directions and cancel in thc vicinity of adjacent, horizontally disposed conductor segments of the loops forming coils 12 and 13. The magnetic flux lines between the centers of the loops forming coils 12 and 13, on one side of the plane of the loops, are directed in the same vertical direction to cause the coils to be effectively a single coil. The vertically directed fluxes provide Z axis coverage for the magnetic field responsive elements in card 17.

The fringing fields resulting from the in phase and out of phase activation of the loops forming coils 12 and 13 provide magnetic flux vectors in the Y axis, i.e., in horizontal planes parallel to the planes containing the loops of tuned transmitter coils 12 and 13 and untuned receiver coils 15 and 16. Thereby, magnetic flux fields in three mutally orthogonal directions are derived from the loops forming coils 12 and 13 by virtue of the in phase and out of phase drives for these coils during different on duty cycle portions of transmitter circuits 23 and 30. These mutually orthogonal magnetic flux vectors provide coupling to enabled magneto-strictive card 17, regardless of the orientation of the card relative to the plane containing planar coils 12 and 13.

When an activated magneto-strictive card 17 is in the region between tuned coils 12, 13 and untuned coils 15, 16 at least one of the untuned coils derives an electric signal that is a replica of the AC magnetic field derived from card 17. Because untuned coils 15 and 16 have different non-overlapping spatial positions relative to each other, and card 17, as well as coils 12 and 13, there is a fairly high likelihood of the electric signals transduced by coils 15 and 16 differing from each other.

Receiver 14 determines if either of coils 15 or 16 is transducing a signal having the predetermined frequency, time duration and threshold amplitude necessary to signal the presence of an activated card in the region between coils 12, 13 and coils 15, 16. The voltages generated by coils 15 and 16 are sequentially coupled to the examining or detecting circuitry of receiver 14 during activation times following each 1.6 millisecond, 60 KHz on duty cycle burst from generator 11. After a first burst one of coils 15 or 16 is coupled to the remainder of receiver 14; after the following burst the other one of coils 15 or 16 is coupled to the remainder of the receiver. In response to one of coils 15 and 16 generating a voltage having the required frequency, duration and amplitude values, the sequential coupling of the coils 15 and 16 to the remainder of receiver 14 is terminated. Coils 15 and 16 are activated in such a situation so that the coil which generated the voltage having the desired frequency, duration and amplitude is the only coil coupled to the remainder of receiver 14, until that coil is no longer receiving a burst having the required frequency, duration and amplitude characteristics. Thereafter, coils 15 and 16 are sequentially and alternately coupled immediately after different bursts from generator 11 to the remaining circuitry of receiver 14.

To these ends, the voltages transduced by untuned coils 15 and 16 are respectively coupled to normally open circuited switches 31 and 32 by way of preamplifiers 33 and 34. During normal operation when no magnetic field having the desired characteristics is coupled to either of coils 15 or 16 immediately after a burst from generator 11, one of switches 31 or 32 is closed for 25 milliseconds simultaneously with the beginning of a 1.6 millisecond burst from generator 11. Simultaneously with the next burst, the other one of switches 31 or 32 is closed for 25 milliseconds. Switches 31 and 32 have a common, normally open circuited terminal connected to an input terminal of automatic gain controlled amplifier 35 by way of series capacitor 36, which enables only AC levels coupled through switches 31 and 32 to be fed to the input of amplifier 35. The gain of amplifier 35 is preset to a predetermined level so that in response to a voltage above a threshold value being induced in one of coils 15 and 16 and coupled to the input of amplifier 35, the amplifier derives a predetermined constant amplitude output having the same frequency as the magnetic field incident on the coil. In response to the input of amplifier 35 being below a threshold level, the amplifier effectively derives a zero level.

Synchronous detector 37 responds to the AC bursts at the output of amplifier 35 which are above the threshold value to determine if these bursts have a carrier frequency equal to the frequency of the AC magnetic field derived from an activated magnetostrictive card 17. In addition, detector 37 determines the duration of bursts having the required carrier frequency. In response to a burst having the required carrier frequency and duration, synchronous detector 37 derives a binary one level which signals that an article containing an activated magneto-strictive card 17 is in the region between tuned coils 12, 13 and untuned coils 15, 16.

To control the operation of receiver 14 so that synchronous detector 37 is energized for the correct time interval associated with activated card 17 being in the region between tuned coils 12, 13 and untuned coils 15, 16 after each burst derived by generator 11, the detector is enabled by an output of frequency synthesizer 38. Synthesizer 38 responds to and is clocked by output pulses of zero crossing detector 39. The output pulses of detector 39 are synchronized with zero crossings of the AC voltage coupled by power line 19 to male plug 22. To this end, zero crossing detector 39 has an input connected to male plug 22, and an output on which a pulse is derived each time a zero crossing of the power line occurs. The pulse output of zero crossing detector 39 is applied to an input of frequency synthesizer 38.

To control the operation of switches 31 and 32 as described supra, logic circuit 41 includes first and second imputs respectively responsive to the output of synchronous detector 37 and frequency synthesizer 38. During normal operation, when synchronous detector 37 derives a binary zero output level to indicate that no activated card is between coils 12, 13 and 15, 16, logic circuit 41 responds to frequency synthesizer 38 so that immediately after first and second successive magnetic field bursts from generator 11, switches 31 and 32 are alternately activated to the closed state. In response to switch 31 being closed at the time synchronous detector 37 derives a binary one level to indicate an enabled card 17 between coils 12, 13 and 15, 16, logic circuit 41 causes switch 31 to be acctivated to the closed state, while maintaining switch 32 in the open state. This state of switches 31 and 32 is maintained until synchronous detector 37 again derives a binary zero level. If synchronous detector 37 derives a binary one level while switch 32 is closed, logic circuit 41 activates switches 31 and 32 so that these switches are respectively maintained in the open and closed states until a binary zero level is again derived by the synchronous detector.

Untuned coils 15 and 16 are effectively decoupled from the remainder of receiver 14 while magnetic fluxes are being derived from coils 12 and 13 because synchronous detector 37 is effectively disabled while magnetic field bursts are derived from them. Detector 37, in fact, is enabled by an output of synthesizer 30 only for a predetermined interval immediately after expiration of each on duty cycle portion of transmitter circuits 23 and 30. In addition, during the on duty cycle portions of transmitter circuits 23 and 30, frequency synthesizer 38 causes the gain of amplifier 35 to be reduced to zero, causing a zero output voltage to be coupled by the amplifier to detector 37. To this end, synthesizer 38 includes an output that is coupled as a control input to switch 43 which is normally activated to couple the output of amplifier 35 back to a gain control input of the amplifier. However, in response to the binary one output of frequency synthesizer 38 being coupled to the control input of switch 43, as occurs during the on duty cycle portions of transmitter circuits 23 and 30, switch 43 is activated to couple a negative DC voltage to a bias input of amplifier 35, to drive the amplifier gain to zero. Frequency synthesizer 38 controls synchronous detector 37 so that integrators in the detector are reset to zero during the on duty cycle portions of transmitter circuits 23 and 30.

DC operating power is supplied to amplifiers 33–35, synchronous detector 37, frequency synthesizer 38, zero crossing detector 39 and logic circuit 41 by DC power supply 42, connected to power line 19 by way of male plug 22.

Reference is now made to FIG. 2, a circuit diagram of the circuitry included in transmitter circuits 23 and 30. Because the circuitry in circuits 23 and 30 is identical, the description of FIG. 2 for transmitter circuit 23 suffices for both of circuits 23 and 30.

Transmitter circuit 23 includes a transformerless AC power line to DC power supply 51, shaping circuit 52 responsive to an output of frequency synthesizer and shaper 25, switch means 53, and resonant circuit 54 that includes coil 12. Shaper 52 responds to the output of frequency synthesizer and shaper 25 to supply switch means 53 with out of phase control signals. Switch means 53 is energized by opposite polarity voltages from transformerless power supply 51 to cause a low duty cycle current to flow in series resonant circuit 54 at the frequency supplied to the switch means by shaper 52.

Transformerless AC power line to DC supply 51 includes full wave bridge rectifier 55, consisting of diodes 56-59, connected directly to power line leads 61 and 62. Diodes 56 and 57 include anodes respectively connected to leads 61 and 62, while diodes 58 and 59 include cathodes respectively connected to leads 61 and 62. Diodes 56 and 57 include cathodes having a common connection to electrode 63 of energy storing filter capacitor 64, while diodes 58 and 59 include anodes having a common connection to a negatively biased electrode 65 of capacitor 66. Electrodes 67 and 68 of capacitors 64 and 66 have a common connection at tap 69 of power supply 51. Positive and negative DC voltages are respectively derived at output terminals 71 and 72 of power supply 51, respectively connected to electrodes 63 and 65.

Switch means 53 inclues NPN bi-polar transistors 74 and 75, respectively having bases driven by out of phase control voltages from shaper 52. Transistors 74 and 75 include collector emitter paths that are forward biased in response to the voltages supplied to the bases thereof by shaper 52 and which are supplied with positive and negative voltages by terminals 71 and 72 of power supply 51. The collectors and emitters of transistors 74 and 75 are respectively connected to terminals 71 and 72, while the emitter of transistor 74 and the collector of transistor 75 have a common terminal 76. The emitter collector paths of transistor 74 and 75 are respectively shunted by diodes 77 and 78, poled so that current flows in them in a direction opposite from the direction of current flow in the respective shunted collector emitter path.

Tap 69 and common terminal 76 are connected to opposite terminals of series resonant circuit 54, including inductive magnetic field transmitting coil 12, tuning capacitor 81 and resistor 82. The value of capacitor 81 is selected so that circuit 54 is resonant to approxiamtely the same frequency as the switching frequency of transistors 74 and 75 during the on duty cycle portions. However, because of deviations in the values of the inductance of coil 12 and the capacitance of capacitor 81, the resonant frequency of circuit 54 is rarely, if ever, exactly equal to the activation frequency of transistors 74 and 75 during the on duty cycle portion. Resistor 82, which controls the Q of the resonant circuit, helps to assure that sinusoidal currents having very low distortion flow in circuit 54 despite the slight deviations in the resonant frequency of circuit 54 in different generator units relative to the drive frequency of switches 74 and 75 during the on duty cycle portion.

In operation, there is a slight dead time between the end of a forward bias interval for the collector emitter path of transistor switch 74 and the initiation of a forward bias for the collector emitter path of transistor 75 during each 60 KHz cycle of the drive provided for the bases of transistors 74 and 75, and vice versa for forward bias transitions from switch 75 to switch 74. The dead time is provided by shaper 52 responding to a 60 KHz input from synthesizer 25, to supply the bases of transistors 74 and 75 with control signals having the complementary waveforms illustrated in FIGS. 3A and 3B.

Transistors 74 and 75 are respectively forward biased during the positive portions of the waves illustrated in FIGS. 3A and 3B. At all other times, transistors 74 and 75 are back biased. While transistor 74 is forward biased, current flows from electrode 63 of capacitor 64 through terminals 71 and the collector emitter path of transistor 74 to common terminal 76, thence through series resonant circuit 54 to tap 69 and back to the negative electrode of capacitor 64. In response to the collector emitter path of transistor 75 being forward biased, current flows from positive electrode 68 of capacitor 66 through tap 69 to series resonant circuit 54 and the collector emitter path of transistor 75 back to electrode 65 of capacitor 66 by was of terminal 72. Thus, current flows in opposite directions through series resonant circuit 54 during the complementary conduction intervals of transistors 74 and 75.

Because of the low duty cycle forward biasing of transistors 74 and 75, there is a relatively low current drain from capacitors 64 and 66 during each on duty cycle portion. This low duty cycle enables the inexpensive transformerless AC to DC converter 51 to be employed. The maximum duty cycle for activating switching transistors 74 and 75 is determined by several factors, such as the response characteristics of magnetostrictive card 17, synchronous detector 37 of receiver 14, and the circuitry and components of AC to DC converter 51.

Diodes 77 and 78 combine with resistor 82 to enable virtually distortion free sinusoidal current to flow in coil 12, even through the resonant frequency of circuit 54 differs slightly from the drive frequency for the bases of transistors 74 and 75. Because of the energy storage characteristics of coil 12 and capacitor 81, there is a tendency for current to continue to flow in resonant circuit 54 after back biasing of transistors 74 and 75. The dead time between the beginning of back biasing of one of these transistors and the forward biasing of the other transistor enables diodes 78 and 79 shunting the transistor emitter collector paths to absorb the current which has a tendency to continue to flow in resonant circuit 54.

When transistors 74 and 75 are driven with the signals illustrated in FIGS. 3A and 3B, the voltage between tap 69 and common terminal 76 has the waveform illustrated in FIG. 3C. This waveform consists of positive and negative levels respectively equal to the voltages of terminals 71 and 72. Between the positive and negative levels of the waveform of FIG. 3C subsist zero voltage levels coicident with the dead times of transistors 74 and 75.

In response to the voltage between tap 69 and terminal 76 impressed across resonant circuit 54 with resonant frequency equal to the activation frequency of transistors 74 and 75, a current having the waveshape illustrated in FIG. 3D flows in the resonant circuit 54.

The resulting voltage between tap 69 and terminal 76 is illustrated in FIG. 3E and results from the continuous current flow through the resonant circuit 54 during the dead time of transistors 74 and 75, via the conduction paths supplied by diodes 77 and 78.

Thus even though there exists a deadtime in the drive signals to transistors 74 and 75, the resultant output voltage across the resonant circuit 54 is without deadtime by virtue of the alternate conduction through diodes 78 and 79 of the current through the resonant circuit 54. Typically, a positive current having a near zero value flows in circuit 54 from terminal 76 towards tap 69 at the time transistor 74 is initially back biased. This current flows through tap 69 into electrode 68 of capacitor 66, through the capacitor and back to common terminal 76 by way of diode 77. When the current in resonant circuit 54 changes polarity during the dead time interval, positive current flows from resonant circuit 54 to terminal 76 and diode 78 to electrode 63 of capacitor 64.

When the emitter collector path of transistor 75 is forward biased, the current flowing from series resonant 54 continues to flow to terminal 76, but now flows through the low impedance collector emitter path of transistor 75 through capacitor 66 to tap 69. While transistor 75 is forward biased, current drains from capacitor 66 into the load provided by series resonant circuit 54 and transistor 75. Thus, while transistor 75 is forward biased, current flows from tap 69 to terminal 76 through series resonant circuit 54 in a direction opposite from the direction of current flow through the series resonant circuit while transistor 74 is forward biased. When transistor 75 is cut off, the current flowing in resonant circuit 54 through terminal 76 is shifted so that it flows through diode 78 to assist in recharging capacitor 64. Such current flow continues during the dead time until there is a reversal in the direction of current flow in resonant circuit 54, at which time capacitor 66 is supplied with charging current by way of the path completed through diode 77.

During the off duty cycle portion, as subsists for more than 90% of the time with the specified on and off duty cycle durations of 1.6 and 23.4 milliseconds, respectively, the rectified DC voltage supplied to terminals 71 and 72 by diode bridge rectifier 75 causes capacitors 64 and 66 to be recharged.

The value of resistor 82 is selected so that the Q of tuned resonant circuit 54 is at least equal to eight to assist in providing the desired low distortion sinusoidal current. The peak amplitude of the sinusoidal current flowing in resonant circuit 54 is determined to a large extent by the resistance of resistor 82, and is approximately equal to the peak amplitude of the output voltage of inverter 51, between terminals 71 and 72, divided by the resistance of resistor 82.

The frequency of current flowing in series resonant circuit 54 is determined by the 60 KHz operating frequency quency of transistors 74 and 75, even if there is a deviation in the resonant frequency of circuit 54 from the operating frequency of the transistors. In such a situation, diodes 77 and 78 conduct the leading and lagging currents which respectively flow in resonant circuit 54 in response to the activation of frequency of transistors 74 and 75 being respectively less than and greater than the resonant frequency circuit 54.

Because of the switch-mode operation of transmitter circuit 23, wherein transistors 74 and 75 are operated in fully on and fully off modes, the power dissipation level of the circuit is much lower than prior art devices. The switch-mode operation of transmitter 11 with the resonant load provided by circuit 54 reduces stresses and switching losses of transistors 74 and 75, to increase reliability and efficiency of the device.

Figure 4:
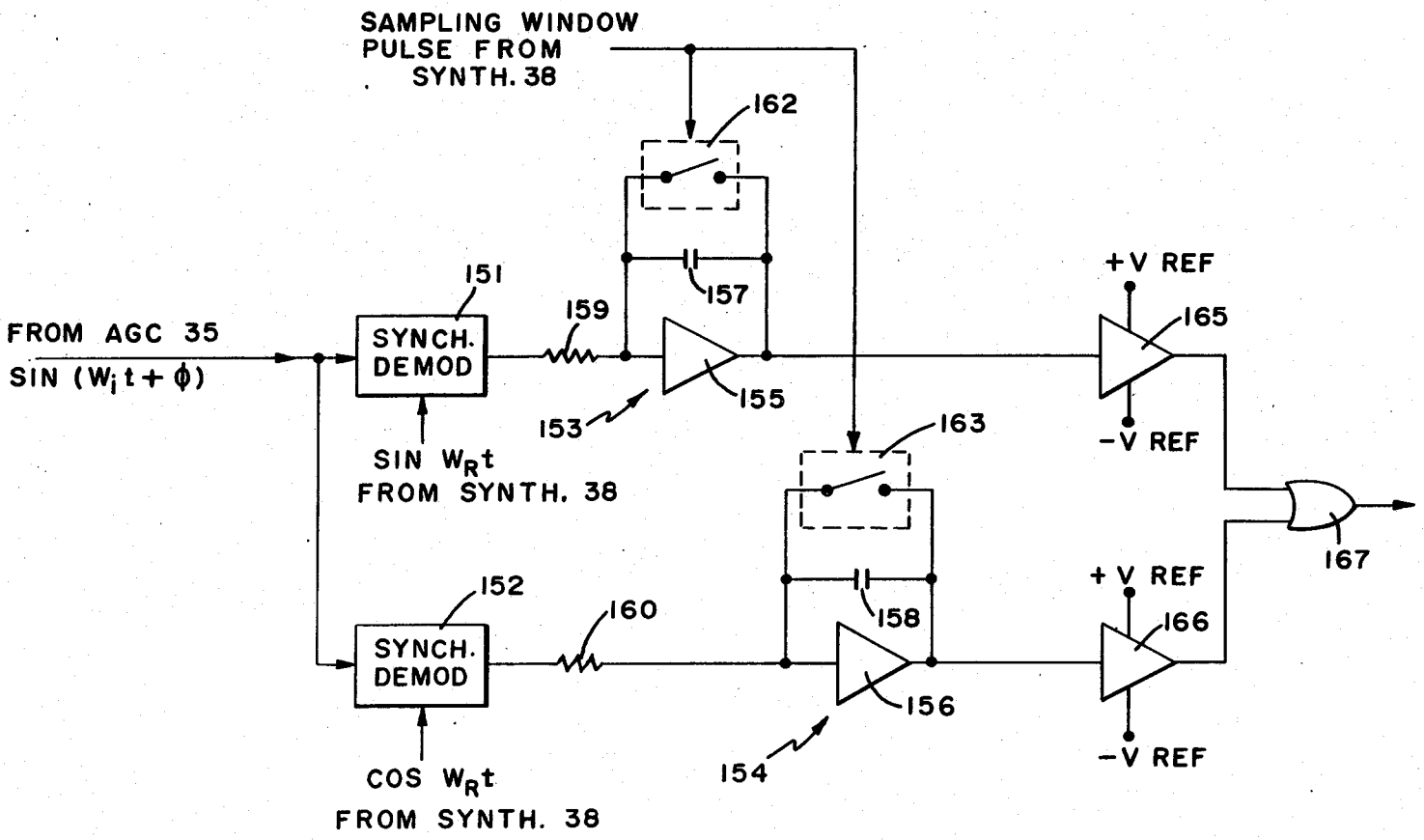
FIG. 4 is a circuit diagram of the receiver illustrated in FIG. 1.

Reference is now made to FIG. 4 of the drawing wherein synchronous detector 37 is illustrated as including synchronous demodulators 151 and 152, driven in parallel by the output of AGC amplifier 35. When an activated magneto-strictive card 17 is in the region between tuned transmitter coils 12, 13 and untuned receiver coils 15, 16, the output of amplifier 35, at the inputs of demodulators 151 and 152, can be assumed to be a constant amplitude sinusoid, except while coils 12 and 13 are excited during the on-duty cycle portion of generator 11. The sinusoidal input signal to demodulators 151 and 152 from amplifier 35 can be assumed to vary in accordance with:

$$\sin(\omega_i t+\phi),$$

where:

$\omega_i$ is the angular frequency of the AC wave derived from enabled card 17 after the on-duty cycle portion of transmitter 11 has terminated, t=time, and $\phi$=the variable unpredictable phase of the carrier wave frequency derived from the structure on enabled card 17, as incident on the coil 15 or 16 feeding the remainder of the receiver.

For the purposes of this description it is assumed that the sinusoidal inputs to demodulators 151 and 152 subsist for the entire off-duty cycle portion of transmitter 11. In actuality, however, the sinusoidal inputs to demodulators 151 and 152 are damped sinusoids having a finite value during only a portion of the off-duty cycle portions of transmitter 11. When the amplitude of the damped sinusoid drops below a certain level, the inputs to demodulators 151 and 152 drop to zero, because of the characteristics of amplifier 35. As long as the sinusoid is above a predetermined level, the output amplitude of amplifier 35 is constant. The length of the constant amplitude sinusoidal output of amplifier 35 during each off-duty cycle portion of generator 11 is variable, as a function of the orientation of card 17 relative to tuned transmitter coils 12, 13 and untuned receiver coils 15, 16, as well as the location of the card in the region between the coils. However, due to the detection process employed in detector 37, the number of cycles of the carrier frequency $\omega_i$ from a typical enabled card in the region is sufficient to cause accurate detection of the card.

Synchronous detectors 151 and 152 are driven by orthogonal components of a reference wave, assumed to have a reference phase. The second inputs of synchronous demodulators 151, 152 can be respectively represented by:

$$\sin\omega_R t, \text{ and}$$

$$\cos\omega_R t,$$

where:

$\omega_R$=the angular frequency of the reference wave, which in turn is equal to the frequency of the AC carrier wave derived from the structure on card 17.

Synchronous demodulator 151 responds to the $\sin(\omega_i t+\phi)$ and $\sin\omega_R t$ inputs thereof to derive an output represented by:

$$\sin(\omega_i t+\phi)\sin\omega_R t.$$

Similarly, synchronous demodulator 152 multiplies the two input signals thereof to derive an output signal represented by:

$$\sin(\omega_i t+\phi)\cos\omega_R t.$$

The output signals of synchronous demodulators 151 and 152 are bipolarity signals that vary between plus and minus reference values, dependent upon the relative values of $\omega_i$, $\phi$ and $\omega_R$. In response to $\omega_i$ and $\omega_R$ being equal, the outputs of demodulators 151 and 152 are DC voltages. If, however, $\omega_i$ differs from $\omega_R$, because $\omega_i$ originates from a signal source other than card 17, demodulators 151 and 152 derive AC signals at the sum and difference frequencies $(\omega_i+\omega_R)$ and $(\omega_i-\omega_R)$.

The indicated responses at the outputs of demodulators 151 and 152 are considered only for the difference or beat frequency $(\omega_i-\omega_R)$. No consideration of the sum frequency ($\omega_i$+107 $_R$) is necessary because the integration performed by detector 37 reduces these high frequency components to insignificant levels.

The output signals of demodulators 151 and 152 are respectively applied to analog signal integrators 153 and 154. Integrators 153 and 154 are standard integrators including high gain DC operational amplifiers 155 and 156, feedback capacitors 157 and 158, as well as input resistors 159 and 160. Integrators 153 and 154 are reset to zero, except during a sampling window having a duration T, during which the integrators are effectively responsive to output signals of demodulators 151 and 152. To this end, capacitors 157 and 158 are short-circuited by switches 162 and 163 which shunt them, except during the sampling window, which begins almost immediately after the expiration of each on-duty cycle portion of transmitter 11. Switches 162 and 163 are simultaneously driven into the closed and open states by an output of synthesizer 30. The duration of sampling window T depends on the desired bandpass of synchronous detector 37, as described infra. The sampling window begins simultaneously with the AGC amplifier 35 being switched into an operative condition by switch 43 being coupled between the output of the amplifier and the bias input thereof.

The output levels of integrators 153 and 154 are constantly monitored by comparators 165 and 166, respectively. Comparators 165 and 166 normally derive binary zero level outputs. However, in response to the absolute value of the inputs of comparators 165 and 166 exceeding a reference value, $V_{REF}$, the comparators derive binary one output levels. The binary one output levels of comparators 165 and 166 are combined in OR gate 167. A binary one level is thus derived from OR gate 167 in response to the absolute value of the integrated response over the sampling window exceeding reference value $V_{REF}$. Comparators 165 and 166 derive the stated outputs in response to DC reference levels $+V_{REF}$ and $-V_{REF}$ being supplied thereto by DC supply 42.

Signal integrators 153 and 154 derive output voltages which linearly increase with time in response to DC outputs of synchronous demodulators 151 and 152 in accordance with:

$$V_1 = \int_0^T [\sin(\omega_i t + \phi)\sin\omega_R t]dt, \text{ and}$$

$$V_2 = \int_0^T [\sin(\omega_i t + \phi)\cos\omega_R t]dt.$$

For the case where frequency $\omega_i$ is the same as reference frequency $\omega_R$, as subsists when enabled card 17 is in the region between the transmitter and receiver coils, the output signals of integrators 153 and 154 at the completion of the sampling window, and prior to closure of switches 162 and 163, are respectively represented by $V_1=T/2 \cos \phi$ and $V_2=T/2 \sin \phi$. Hence, the amplitudes at the outputs of integrators 153 and 154 are solely proportional to the duration of receiver sampling window T and the relative phase angle $\phi$ between the signal coupled in parallel to demodulators 151 and 152 and the reference phase for $\omega_R$.

Because the relative phase angle $\phi$ is unpredictably variable between 0° and 360°, voltages $V_1$ and $V_2$ are bipolarity voltages, having an amplitude indicative of $\phi$. This is why it is necessary to compare the absolute values of the outputs of integrators 153 and 154 with the reference level $V_{REV}$. The magnitude of $V_{REF}$ is selected so that the constant amplitude sinusoidal input $\sin(\omega_i t+\phi)$ supplied to demodulators 151 and 152 results in a binary one output of each of comparators 165 and 166 when $\phi=45°$. The value of $V_{REF}$ can be determined to be equal to approximately 0.35T by equating $V_1=T/2 \cos \phi$ for $\phi=0$, by using the actual value of $V_1$ at time T and taking into account the input amplitude level and transfer function of integrators 153 and 154. This value of $V_1$ is multiplied by cos 45° (equal approximately to 0.707), resulting in T/2 cos 45° =0.35T. By setting $V_{REF}$=0.35T all input signals having a frequency $\omega_i=\omega_R$ are detected, regardless of phase since either $V_1$ or $V_2$ is never less than 0.35T.

The duration of window T determines the effective bandpass of synchronous detector 37. If window T is long enough, any frequency $\omega_i$ which differs from $\omega_R$ will not be detected. This is because the beat frequencies derived by demodulators 151 and 152 ultimately are averaged by integrators 153 and 154 to a zero level. For the case of $\omega_i$ not equal to $\phi_R$, the output voltages of integrators 153 and 154, at the completion of sampling window T are represented by:

$$V_1 = \int_0^T [\sin(\omega_i t + \phi)\sin\omega_R t]dt = \frac{\sin[(\omega_i - \omega_R)t + \phi]}{2(\omega_i - \omega_R)}, \text{ and}$$

$$V_2 = \int_0^T [\sin(\omega_i t + \phi)\cos\omega_R t]dt = \frac{-\cos[(\omega_i - \omega_R)t + \phi]}{2(\omega_i - \omega_R)}$$

Thus, integrators 153 and 154 respond to the beat frequencies, $(\omega_i-\omega_R)$ , derived from demodulators 151 and 152. Integrators 153 and 154 average the sum frequencies, (107 $_i+\omega_R$), to insignificant levels, whereby the sum frequencies have no effect on the values of $V_1$ and $V_2$.

The band width of the demodulation and integration process can be determined by evaluating the two last presented equations at time t=0 and any other time t between zero and the maximum duration that the sinusoidal voltage can be derived from demodulators 151 and 152 for a response from magneto-strictive card 17. The band width $(\omega_i-\omega_R)$ or $(\omega_R-\omega_i)$ is determined by using the actual values for time T and the input amplitude level and transfer functions of integrators 153 and 154 to calculate the magnitudes of $V_1$ and $V_2$. Taking into account the previously calculated value for $V_{REF}$=0.35T, the pass band of detector 37 is equal to ±1/2T. Typically, T=1.6 milliseconds, to provide the system with a pass band of approximately ±300 Hz.

The synchronous demodulator-integration process achieved by demodulators 151 and 152 and integrators 153 and 154 thus has a narrow frequency bandpass for long term sinusoidal signals, without including any tuned components. In addition, the demodulation-integration process is immune to impulse type noise, even though an impulse contains energy at all frequencies, including $\omega_R$. The energy at any particular frequency, including $\omega_R$, has a short duration which prevents the output signals of integrators 153 and 154 from having an absolute value in excess of reference value $V_{REF}$. Thus, receiver 14 is capable of discriminating an input signal having a frequency $\omega_R$, with a variable unpredictable phase, and predetermined time position in the presence of background energy, as subsists in impulse type noise. This is because of the synchronous detection process provided by synchronous demodulators 151 and 152 and the time duration detecting process involving signal integrators 153 and 154.

Figure 5:
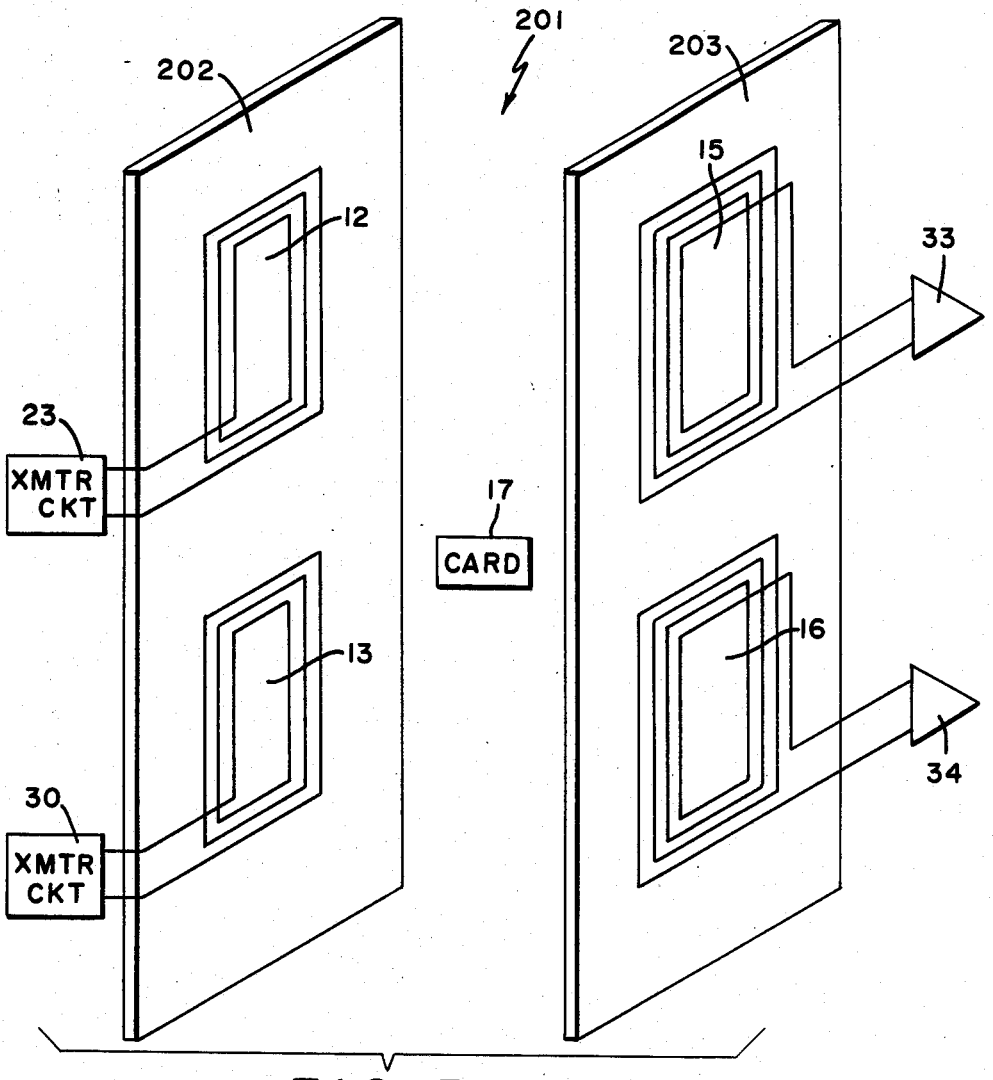
FIG. 5 is a schematic view of a surveillance system including transmitter and receiver coils in accordance with the invention.

Reference is now made to FIG. 5 of the drawing wherein planar, tuned transmitter coils 12 and 13 and untuned receiver coils 15 and 16 are mounted in surveillance region 201 through which magneto-strictive card 17 can pass on an article under surveillance. Transmitter coils 12 and 13 are mounted in wall 202, which is disposed parallel to wall 203, containing untuned receiver coils 15 and 16. Coils 12 and 13 are mounted so that the common plane containing the coils is parallel to the planar face of wall 202. Similarly, the common plane of coils 15 and 16 is mounted parallel to the planar face wall 203. Thereby, transmitter coils 12 and 13 are mounted with the planes thereof in a first vertical plane which is parallel to a second vertical plane containing coils 15 and 16.

Coils 12 and 13 are wound as rectangular loops including horizontally and vertically extending conductor segments. There is no overlapping portion of coils 12 and 13, so that the adjacent, horizontally extending segments of the loops forming coils 12 and 13 are either spaced slightly from each other or abut against each other without overlap. The spatial arrangement of the planar loops forming coils 15 and 16 is identical to that of coils 12 and 13, whereby the centers of coils 12 and 15 are aligned, as are the centers of coils 13 and 16.

The horizontal and vertical conductor segments forming the loops of coils 12 and 13 respectively extend one foot and two feet, with a typical spacing between the adjacent horizontally extending conductor segments being about one and one-half to two inches, in the preferred embodiment. Similarly, the horizontal and vertical extents of the conductors in the loops forming coils 15 and 16 are respectively one foot and two feet, with a separation between the two loops equal to the separation between the loops forming coils 12 and 13.

The wires forming the loops of coils 12 and 13 are wound so that each loop includes ten turns of No. 14 AWG wire. Such a configuration has an inductance of approximately 166 microhenries and a resistance of approximately 0.2 ohms. To resonate coils 12 and 13 at a frequency of 60 KHz requires the capacitors 81 of transmitter circuits 23 and 30 to be approximately 0.047 microfads. To provide resonant circuit 54 in which antenna coils 12 and 13 are connected with a Q of approximately 15, resistor 82 in each of circuits 23 and 30 has a value of approximately 4 ohms. Thereby, a relatively high Q circuit is provided for each of coils 12 and 13, at a resonant frequency of approximately 60 KHz, the frequency that switches 74 and 75 are driven by shapers 52 in circuits 23 and 30.

In the preferred embodiments, each of untuned coils 15 and 16 has an extremely wide band pass, with a resonant frequency considerably removed from the fequency of the approximately 60 KHz AC field derived from enabled card 17 after it has been excited by 60 KHz energy from coils 12 and 13. The wide band characteristics of coils 15 and 16 are achieved by forming the coils so that they have a very low Q, considerably less than one. In one preferred embodiment, each of coils 15 and 16 has an inductance of approximately 4 nanohenries and a resonant frequency of approximately 100 KHz, with a Q of less than 0.01, and a resistance of approximately 10 ohms. To achieve these parameters, each of coils 15 and 16 is wound as a loop of fifty turns of No. 24 AWG wire.

The low Q nature inherent in the construction of coils 15 and 16 is retained in the processing circuitry which is responseive to the outputs of preamlifiers 33 and 34 to which coils 15 and 16 are respectively connected. As described supra in connection with FIG. 4, the processing circuitry does not include any high Q band pass filter elements which have a tendency to ring in response to impulse noise. Similarly, the low Q, wide band pass characteristics of coils 15 and 16 prevent ringing thereby in response to magnetic impulse noise. Because the resonant frequency of each of coils 15 and 16 is approximately 100 KHz, the approximately 60 KHz waves induced in the coils by the magnetic field from the structure on card 17 causes the coils to have a linear response.

As discussed supra, transmitter circuits 23 and 30 excite coils 12 and 13 simultaneously, such that during a first on duty cycle activation time of the coils, the coils are driven so that they have in phase magnetic fields; during the next on duty cycle activation portion, transmitter circuits 23 and 30 activate coils 12 and 13 so they have out of phase magnetic fluxes. This alternate in phase and out of phase drives for coils 12 and 13 enable the coils to couple magnetic fields in three mutually orthogonal directions to card 17. Thereby, regardless of the orientation and loation of card 17 relative to coils 12 and 13, the magneto-strictive structure on the card responds to the magnetic field from coils 12 and 13 and re-radiates a magnetic field which is transduced by coils 15 and 16.

Figure 6A:
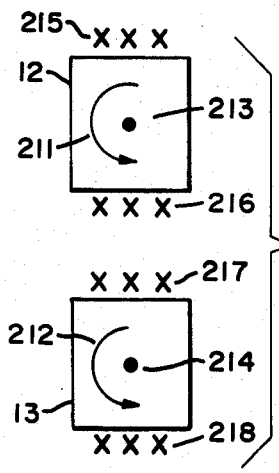
FIGS. 6A and 6B are diagrams helpful in describing the magnetic flux paths for the generator coils in the system of FIG. 1.
Figure 6B:
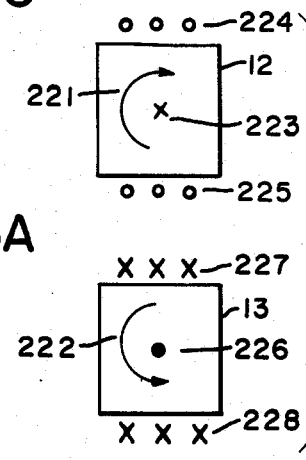

The in phase and out of phase magnetic fields produced by coils 12 and 13 are schematically illustrated in FIGS. 6A and 6B, respectively. As illustrated in FIG. 6A, when coils 12 and 13 are driven with in phase currents, as illustrated by arrows 211 and 212, magnetic flux lines extend at right angles to the plane of the coils, as indicated by dots 213 and 214, as well as crosses 215–218. Dots 213 and 214 represent magnetic field flux lines directed out of the plane containing coils 12 and 13, in the centers of the coils. Crosses 215–218 represent magnetic field flux lines directed into the plane of coils 12 and 13. Magnetic flux lines represeted by dot 213 and crosses 215 and 216 close on each other, with the magnetic flux lines represented by crosses 215 and 216 respectively subsisting across the top and bottom portions of the loop forming coil 12. Similarly, magnetic fluxes represented by dot 214 and crosses 217 and 218 close on each other, with the magnetic flux lines represented by crosses 217 and 218 respectively subsisting in the vicinity of the top and bottom of loop 133. The magnetic flux lines represnted by crosses 216 and 217 thus additively combine in the horizontal direction in the vicinity of the adjacent portions of the wires of the loops forming coils 12 and 13. This provides a relatively intense horizontal magnetic field in the X axis direction between the faces of walls 202 and 203.

Out of phase excitation of coils 12 and 13 results in a vertically directed, Z axis magnetic field in the space between the faces of walls 202 and 203. As illustrated in FIG. 6B, for the out of phase situation, currents indicated by arrows 221 and 222 flow in opposite directions in coils 12 and 13. The current indicated by arrow 221 produces a magnetic field represented by cross 223 in the center of coil 12 and by dots 224 and 225 respectively in the vicinity of the top and bottom conductors of coil 12. The current flow indicated by arrow 222 produces magnetic flux lines in coil 13, as represented by dot 226 at the center of the coil and crosses 227 and 228, respectively in proximity to the top and bottom conductors of coil 13.

The magnetic flux lines represented by cross 223 flow at right angles to the plane of coil 12, into the plane of the coil, while the magnetic flux lines represented by dots 224 and 225 flow out of the plane containing coil 12. The magnetic field flux lines represented by cross 223 and dots 224 and 225 close on each other. In a similar, but opposite manner, the magnetic flux lines represented by crosses 227 and 228 flow into the plane of loop 13, i.e., in a direction opposite to the direction of the magnetic flux lines indicated by dots 224 and 225. The oppositely directed magnetic flux lines indicated by dots 225 and crosses 227 in the vicinity of adjacent horizontal conductors of loops 12 and 13 cancel. Hence, there is virtually no magnetic field in the center of an array formed by the loops of coils 12 and 13, when these loops are excited to have out of phase fluxes. When loops 12 and 13 are excited to have out of phase fluxes, the magnetic flux lines indicated by cross 223 are directed in the same vertical direction as the magnetic flux lines associated with dot 226. Hence, there is a substantial vertically directed, Z axis magnetic flux field in surveillance region 201 between the faces of walls 202 and 203.

From the foregoing, it is apparent that the in phase and out of phase fluxes of coils 12 and 13 produce horizontally and vertically directed fields between the faces of walls 202 and 203. A third magnetic flux field subsists in the horizontal direction, i.e., in the Y axis direction, between walls 202 and 203 as a result of fringing effects from the magnetic fields produced by the in phase and out of phase drives for coils 12 and 13.

Because of the different spatial positions of untuned receiver coils 15 and 16, the magnetic flux fields induced therein in response to enabled card 17 passing through surveillance zone 201 are likely to differ. As described supra, output signals of receiver coils 15 and 16 are sequentially coupled to the remainder of receiver 14 to determine if either of them is deriving a signal that results in detector 37 deriving an indicating that enabled card 17 is in the surveillance region.

Figure 7:
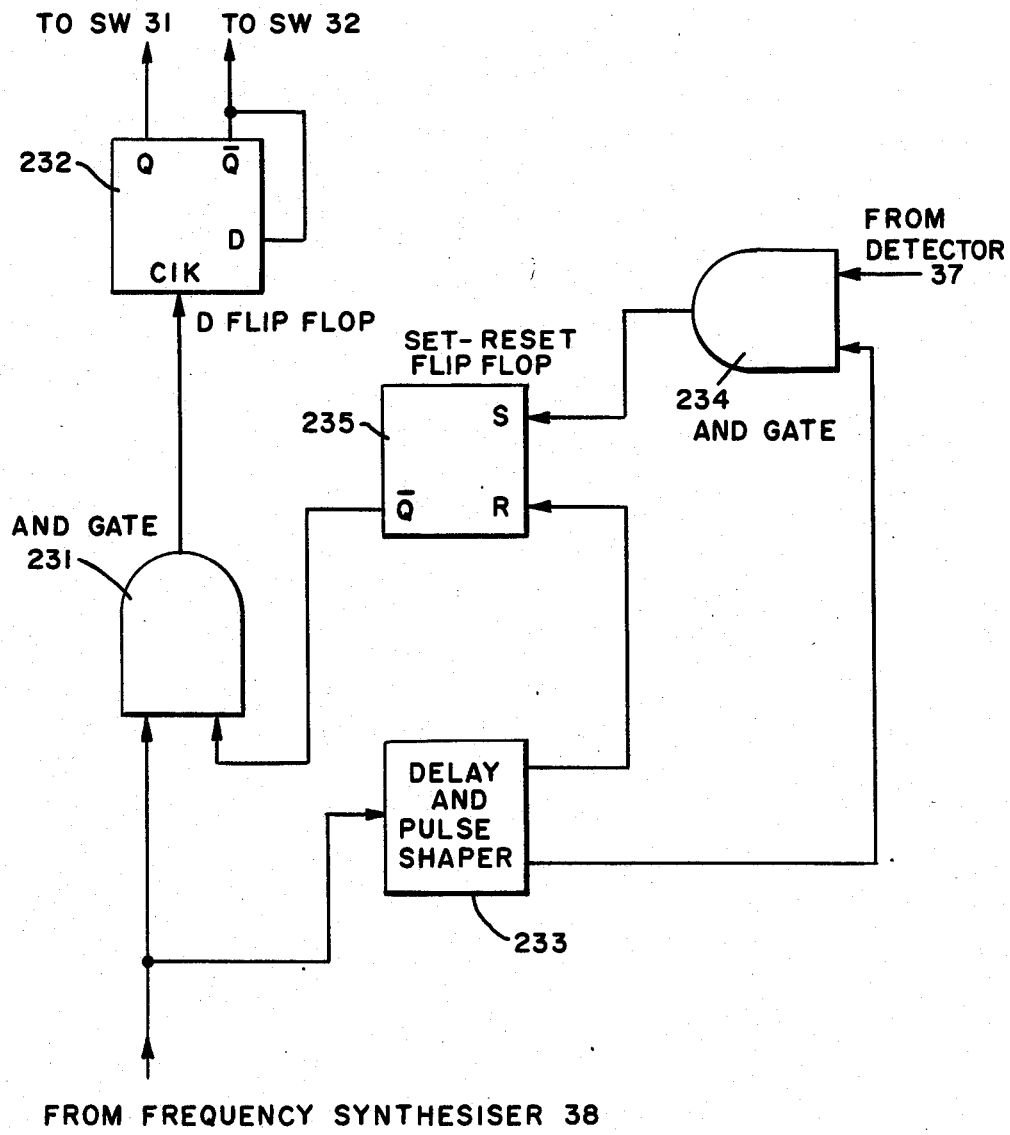
FIG. 7 is a circuit diagram of the logic circuit illustrated in the receiver of FIG. 1.

To achieve these ends, logic circuit 41, as illustrated in FIG. 7, is included. Basically, logic circuit 41 responds to frequency synthesizer 38 to alternately close switches 31 and 32 during different successive detection cycles of receiver 14, which occur immediately after successive, different alternate on duty cycle portions of coils 12 and 13. In response to one of coils 15 or 16 causing detector 37 to derive an output indicative of the presence of card 17 in surveillance zone 201, logic circuit 41 maintains the switch which was closed in a closed condition.

To these ends, logic circuit 41 includes AND gate 231 having a first input responsive to an output of frequency synthesizer 38 at the 40 Hz activation frequency of the on duty cycle portions of generator 11. Frequency synthesizer 38 supplies gate 231 with a short duration binary one level coincident with the start time of each on duty cycle portion of transmitter circuits 23 and 30. Gate 231 is normally enabled to pass the output of frequency synthesizer 39 to a clock input terminal of toggle or D flip-flop 232, having complementary Q and $\overline{Q}$ outputs which respectively control opening and closing of switches 31 and 32. In response to the Q output of flip-flop 232 having binary one and zero states, switch 31 is respectively closed and opened. Similarly, binary one and zero states for the $\overline{Q}$ output of flip-flop 232 result in switch 32 being closed and opened.

Pulses from frequency synthesizer 38 are inhibited by AND gate 231 in response to synchronous detector 37 detecting a 60 KHz response from card 17. To these ends, the output of synthesizer 38 is coupled to delay network and pulse shaper circuit 233. Circuit 233 derives a short duration output pulse that is delayed relative to the input of gate 231 from synthesizer 38 by a sufficient time to enable derivation by detector 37 of a binary one signal indicating the presence of magnetostrictive card 17.

This pulse output of circuit 233 is applied to AND gate 234. The output of gate 234 is applied to the set input of set-reset flip flop 235.

Delay and pulse shaper circuit 233 also generates a second output in the form of a short duration pulse coincident with the termination of the on duty cycle portion of transmitter circuits 23 and 30. This second output is applied to the reset input of set-reset flip flop 235.

In response to detector 37 deriving a binary one output to indicate the presence of card 17, gate 234 is enabled to cause the $\overline{Q}$ output of flip flop 235 to be set to the zero state.

In contrast, in response to detector 37 deriving a binary zero output while a pulse is derived from circuit 233, AND gate 234 remains in its binary zero state hence the $\overline{Q}$ output of flip flop 235 remains in a binary one state initiated by the reset pulse output of circuit 233.

When the $\overline{Q}$ output of flip flop 235 is set to its binary zero state in response to detector 37 indicating the presence of card 17, the output of AND gate 231 is disabled. This prevents the output of frequency synthesizer 38 from clocking D flip flop 232 at the 40 Hz activation frequency of the on duty cycle portions of generator 11. Therefore, the Q and $\overline{Q}$ binary output states of flip flop 232 which control the one and off states of switches 31 and 32 respectively, are preserved. Hence the states of switches 31 and 32 are maintained until the AND gate 231 allows the frequency synthesizer 38 to further clock flip flop 232. The clocking of flip flop 232 does not resume until detector 37 ceases to derive a binary one level indicating that card 17 is no longer present in surveillance zone 201. When detector 37 derives a binary zero level indicating the absence of card 17, the $\overline{Q}$ output of flip flop 235 remains in its binary one state as a result of being reset by the pulse generated by delay and pulse shaper 233.

Therefore, the clocking of flip flop 232 and hence alternate selection of switches 31 and 32 is resumed.

While there has been described and illustrated one specific embodiment of the invention, it will be clear that variations in the details of the embodiment specifically illustrated and described may be made without departing from the true spirit and scope of the invention as defined in the appended claims.

I claim:

1. An inductive magnetic field article surveillance system wherein articles to be monitored include a structure for receiving a first inductive magnetic field having a predetermined frequency and for deriving a second inductive magnetic field having a predetermined frequency comprising means for generating the first magnetic field, said generating means including: inductive transmitter coil means for generating the first magnetic field; the structure responding to the first magnetic field to derive the second magnetic field; an inductive magnetic field receiver responsive to the second magnetic field, said receiver including: inductive receiver coil means responsive to the second magnetic field for deriving a signal that is a replica of variations of the second magnetic field, processing means responsive to the receiver coil means, the receiver coil means including: first and second coils susceptible of having different responses to said second magnetic field as incident on the receiver coil means, means for connecting only one of said first and second coils to the processing means at a time as a function of which coil supplies a signal at the predetermined frequency of the second field to the processing circuitry for at least a predetermined time interval.

2. The system of claim 1 wherein the means for connecting only one of said coils at a time to the processing means includes means for normally sequentially connecting the first and second coils to the processing means, and feedback means responsive to an output signal of said processing means indicating the presence of an article having the structure emitting the second magnetic field for controlling the connections of the first and second coils to the processing means.

3. The system of claim 2 wherein the feedback means includes means for decoupling the other of said coils from the processing means as long as the one coil continues to supply the predetermined frequency of the second field to the processing means.

4. The system of claim 3 wherein the processing means includes: synchronous demodulator means responsive to the signal derived by the receiver coil means and to a reference signal having a reference phase at the predetermined frequency of the second magnetic field for deriving another signal having an amplitude indicative of the phase displacement between the replica and the reference phase, and means for integrating the another signal for the predetermined time interval.

5. The system of claim 1 wherein each of the receiver coils is planar and is vertically mounted.

6. The system of claim 5 wherein each of the receiver coils is formed as a rectangular loop having non-overlapping conductors, said loops being co-planar.

7. An inductive magnetic field article surveillance system wherein articles to be monitored include a structure for receiving a first inductive magnetic field having a predetermined frequency and for deriving a second inductive magnetic field having a predetermined frequency comprising means for generating the first magnetic field, said generating means including: inductive transmitter coil means for generating the first magnetic field; the structure responding to the first magnetic field to derive the second magnetic field; an inductive magnetic field receiver responsive to the second magnetic field, said receiver including: inductive receiver coil means responsive to the second magnetic field for deriving a signal that is a replica of variations of the second magnetic field as incident on the receiver coil means, processing means responsive to the receiver coil means, the receiver coil means including first and second coils susceptible of having different responses to said second magnetic field, and feedback means responsive to an output signal of said processing means for controlling the connections of the first and second coils to the processing means.

8. The system of claim 7 wherein the output signal indicates the presence of an article having the structure emitting the second magnetic field.

9. The system of claim 7 wherein each of the receiver coils is planar and is vertically mounted.

10. The system of claim 9 wherein each of the receiver coils is formed as a rectangular loop having non-overlapping conductors, said loops being co-planar.

11. An inductive magnetic field article surveillance system wherein articles to be monitored include a structure for receiving a first inductive magnetic field and for deriving a second inductive magnetic field comprising means for generating the first magnetic field, said generating means including: inductive transmitter coil means for generating the first magnetic field; the structure responding to the first magnetic field to derive the second magnetic field; an inductive magnetic field receiver responsive to the second magnetic field, said receiver including: inductive receiver coil means responsive to the second magnetic field for deriving a signal that is a replica of variations of the second magnetic field, processing means responsive to the receiver coil means, the receiver coil means including first and second coils susceptible of having different responses to said second magnetic field, means for connecting only one of said first and second coils to the processing means at a time as a function of which coil is supplying a signal indicative of an article having the structure being in an area monitored by the system.

12. The system of claim 11 wherein the means for connecting only one of said coils at a time to the processing means includes means for normally sequentially connecting the first and second coils to the processing means, and feedback means responsive to an output signal of said processing means indicating the presence of an article having the structure being in the monitored area for controlling the connections of the first and second coils to the processing means.

13. The system of claim 12 wherein the feedback means includes means for decoupling the other of said coils from the processing means as long as the one coil continues to supply a signal indicative of the presence of an article having the structure being in the monitored area to the processing means.

14. The system of claim 13 further including means for resuming the sequential connections of the coils to the processing means in response to said one coil no longer supplying a signal indicative of the presence of an article having the structure being in the monitored area.

15. In an inductive magnetic field article surveillance system wherein articles to be monitored include a structure for receiving a first inductive magnetic field and for deriving a second inductive magnetic field, an inductive magnetic field receiver responsive to the second magnetic field, said receiver including: inductive receiver coil means responsive to the second magnetic field for deriving a signal that is a replica of variations of the second magnetic field as incident on the receiver coil means, processing means responsive to the receiver coil means, the receiver coil means including: first and second coils susceptible of having different responses to said second magnetic field, means for connecting only one of said first and second coils to the processing means at a time as a function of which coil is supplying a signal indicative of an article having the structure being in an area monitored by the system.

16. The system of claim 15 wherein the means for connecting only one of said coils at a time to the processing means includes means for normally sequentially connecting the first and second coils to the processing means, and feedback means responsive to an output signal of said processing means indicating the presence of an article having the structure being in the monitored area for controlling the connections of the first and second coils to the processing means.

17. The system of claim 16 wherein the feedback means includes means for decoupling the other of said coils from the processing means as long as the one coil continues to supply a signal indicative of the presence of an article having the structure being in the monitored area to the processing means.

18. The system of claim 17 and means for resuming the sequential connections of the coils to the processing means in response to said one coil no longer supplying a signal indicative of the presence of an article having the structure being in the monitored area.

* * * * *